United States Patent [19]

Hostrup

[11] 4,161,224

[45] Jul. 17, 1979

[54] FLUID DUMP MECHANISM

[75] Inventor: Kai R. Hostrup, Duncan, Okla.

[73] Assignee: Halliburton Company, Duncan, Okla.

[21] Appl. No.: 876,592

[22] Filed: Feb. 10, 1978

[51] Int. Cl.[2] ..... E21B 1/10

[52] U.S. Cl. ..... 175/297; 166/178

[58] Field of Search ..... 175/296, 297; 166/178

[56] References Cited

U.S. PATENT DOCUMENTS

| | | | |
|---|---|---|---|
| 3,735,827 | 5/1973 | Berryman | 175/296 |
| 3,797,591 | 3/1974 | Berryman | 175/296 |
| 3,851,717 | 12/1974 | Berryman | 175/297 |
| 4,059,167 | 11/1977 | Berryman | 175/297 |
| 4,076,086 | 2/1978 | Evans | 175/297 |

*Primary Examiner*—Ernest R. Purser
*Assistant Examiner*—Nick A. Nichols, Jr.
*Attorney, Agent, or Firm*—Floyd A. Gonzalez; John H. Tregoning

[57] ABSTRACT

Disclosed is an apparatus for controlling sliding movement between two telescoping members of a jar or like apparatus for use in an oil well. The telescopic sliding movement between the two members is controlled by a hydraulic impedance device which is bypassed by a hydraulic fluid dump valve after a predetermined amount of telescopic movement between the two members. A dump valve opening means is releasably attached to the walls of one of the members and, after opening the dump valve mechanism, releases from the member wall to move with the telescoping member holding the dump valve mechanism in the open condition. Means is also disclosed for recocking the apparatus and for returning the opening means to its initial position such that the opening means is reattached to the wall of said one member.

5 Claims, 2 Drawing Figures

FLUID DUMP MECHANISM

BACKGROUND AND SUMMARY OF THE INVENTION

The present invention relates to hydraulic impedance mechanisms useful in tools for use in oil and gas wells. More particularly, the invention relates to fluid dump mechanisms for bypassing a hydraulic impedance element for providing a sudden release of hydraulically controlled movement between two members of a jar or like apparatus in an oil well.

During certain operations, such as testing or drilling oil wells, a tubular string is lowered into the borehole of an oil well. Many times, the lower end of the tubular string becomes stuck thus preventing removal of the tubular string from the well bore.

Jars of various types have been developed to impart jarring blows to the tubular string when the tubular string is lifted from the surface. These jarring blows may be imparted to the stuck string over a long period of time such that continuous blow may eventually unstick the tubular string so it may be removed.

The jar is typically operated by pulling on the tubular string from the surface. The jar typically includes two tubular sections which are telescoped one within the other. The pulling on the string from the surface causes the two tubular sections to move relative to one another initially at a controlled rate. This controlled rate allows the tubular string to stretch during the pulling operation. At a predetermined point, the controlled movement of the two tubular sections of the jar is released such that the jar may suddenly be released to move to a fully extended position. When the jar is thus fully extended, a hammer on one tubular section of the jar strikes an anvil on the other section to impart a sharp jarring blow to the tubular string.

The apparatus is then returned to its initial position by lowering the tubular string from the surface. The jarring cycle is then repeated by once again pulling from the surface.

In some apparatus, a sudden release of a controlled movement of the tubular string is used to indicate at the surface the operation of some downhole tool. Such a tool is disclosed in U.S. Pat. No. Re. 29,471 to Giroux.

In a hydraulically controlled apparatus, the initial rate of movement between the two tubular sections is typically controlled by a hydraulic impedance mechanism. At some predetermined point, a bypass means is provided to bypass hydraulic fluid flow around the impedance mechanism such that the two tubular sections may move freely to impart the desired blow or give the desired surface indication.

The apparatus of the present invention includes an outer tubular housing and an inner tubular mandrel arranged for telescopic movement with respect to each other. An oil filled chamber is located between the outer housing and the inner mandrel with a flow regulating piston on the inner mandrel dividing the oil filled chamber.

A flow regulating means such as a Lee Visco Jet is provided through the flow regulating piston such that the inner mandrel moves with respect to the outer housing at a controlled rate.

In the illustrative embodiment, a dump valve in the inner mandrel is disclosed which is designed to open after a predetermined amount of movement of the inner mandrel. Upon the opening of the dump valve, hydraulic fluid is freely dumped from one side of the control piston to the other side such that the mandrel may freely slide with relation to the outer housing to deliver a jarring blow of a hammer on the inner mandrel upon an anvil provided on the outer housing.

An opening means for opening the dump valve is disclosed which is releasably attached to the outer housing. The opening means is designed to remain attached to the outer housing until the dump valve means is open, and then to be released from the outer housing and to travel with the inner sliding mandrel holding the dump valve means open until the mentioned jarring blow is struck.

The opening means is moved by the inner sliding mandrel back to its original position during a recocking operation in which the inner mandrel and the outer housing is moved back to the fully extended position.

A bypass means is disclosed in the piston means which serves to bypass the flow control device during the recocking operation.

THE DRAWINGS

FIG. 1*a* and FIG. 1*b*, joined along section line a—a, discloses an embodiment of the invention in a jarring mechanism with the right side sectioned to show the interior of the embodiment.

DESCRIPTION OF THE PREFERRED EMBODIMENT

Figure 1A:
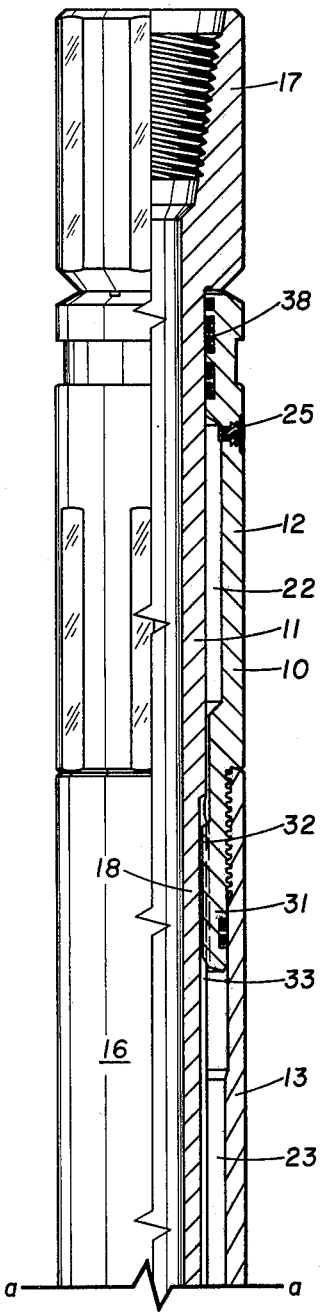

The jar apparatus includes an outer tubular housing assembly 10, and an inner sliding mandrel assembly 11 located longitudinally therein and having an open bore 16 therethrough. The outer housing assembly 10 includes an upper housing section 12, an intermediate housing section 13, and a lower housing section 14 having threads 15 for threadably attaching the apparatus into a drill string below the apparatus. The inner sliding mandrel assembly 11 extends partly out of one end of the outer housing assembly 10 and includes an upper threaded adapter 17 for attaching the apparatus to a drill string above the jar. The inner mandrel assembly 11 further includes an inner mandrel 18 which is an extension of adapter 17, a metering mandrel 19, and a follower mandrel 20, all threadably attached and arranged for sliding movement within the housing assembly 10.

An oil filled chamber is provided between the outer housing assembly 10 and the inner sliding mandrel assembly 11 and may be conveniently considered to include an upper oil filled chamber 22, an intermediate oil filled chamber 23 and a lower oil filled chamber 24. Access is provided to the mentioned oil filled chambers by filling means such as the ports sealed by appropriate plugs provided in the walls of the housing assembly as shown by reference numerals 25 and 26.

Figure 1B:
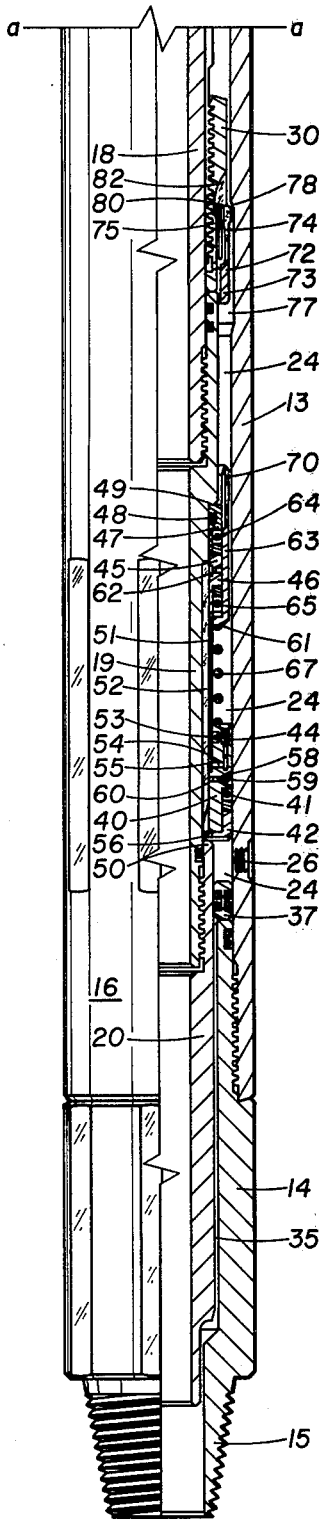

A hammer 30 is provided on the inner sliding mandrel 18 which is an annular projection extending from the outer periphery of the inner sliding mandrel 18 into the oil filled chamber 23 as shown in FIG. 1*b*. A corresponding anvil 31 is formed by an extension of the housing section 12 and projects inwardly from the housing assembly 10 into the oil filled chamber 23. Interconnecting splines 32 and 33 are provided on anvil 31 and mandrel 18, respectively. These interconnecting splines 32 and 33 prevent rotation between the outer housing assembly 10 and the inner mandrel assembly 11 such that torque may be transmitted through the jar from the drill string portion above the jar to the drill string portion below the jar. Splines 32 and 33 are dimensioned such that there is a free oil flow between oil filled chambers 22 and 23 as the volumes of these chambers change with the sliding movement of the inner mandrel assembly 11 with respect to the housing assembly 10.

At the lower end of the jar, an annular flow passage 35 is provided between the interior bore 16 of the apparatus and the lower end of lower chamber 24. A floating piston 37 is provided in chamber 24 to form a movable lower end of oil filled chamber 24 and arranged such that the floating piston will move responsive to volume changes in the oil in the interconnecting chambers 22, 23 and 24. These oil volume changes may be caused by changing pressure and temperature as the jar is lowered into the well bore of an oil well.

Sealing means 38 is provided between assemblies 11 and 12 to form a seal for the upper end of upper oil filled chamber 22.

Dividing lower oil filled chamber 24 and attached to the inner sliding mandrel assembly is metering piston 40. Around the periphery of metering piston 40 is a sealing means 41 which is held in place by a metering piston and seal retainer 42. The metering effect of the metering piston is achieved by a metering means 44 such as a Lee Visco Jet sold by the Lee Company of Westbrook, Conn.

Also attached to the inner sliding mandrel, is dump valve 45 whih has a dump valve sleeve 46 and a dump valve sleeve retainer 47. A sealing means 48 is provided between the dump valve sleeve retainer 47 and the metering mandrel 19 of the inner mandrel assembly 11.

It will be noted that a shoulder 49 is provided on mandrel 19. Likewise, a shoulder 50 is provided where mandrel 19 is threaded into follower mandrel 20 such as is shown in FIG. 1*b*. An extension 51 of the dump valve sleeve 46 acts as a spacer to separate the dump valve mechanism 45 from the metering piston 40.

When the dump valve mechanism 45 and the metering piston 40 are assembled and the threaded connection between the valve metering mandrel 19 and the follower mandrel 20 is made up, the shoulder 50 impinges on the seal retainer 42 and the shoulder 49 impinges on the seal retainer 48 such that the dump valve mechanism 45 and the metering piston 40 are held rigidly in place.

A fluid passageway 52 is provided by a plurality of longitudinal grooves in metering mandrel 19 and extend from the dump valve mechanism 45 through the metering piston arrangement 40. The extension 51 of the dump valve sleeve 46 is arranged to be concentrically located over the grooves 52, and a seal 53 is provided to limit fluid communication between fluid chamber 24 and the grooves 52 to be through the metering device 44 and flow ports 54 provided in the metering piston 40. Flow ports 55 are additionally provided in the lower end of extension 51 to provide fluid communication from port 54 to the fluid passageway provided by grooves 52. Additionally, flow ports 56 are provided through the end of retainer 42, and the end of retainer 42 is chamfered to provide for an unrestricted flow through the end of retainer 42 from the fluid passageway provided by grooves 52 and the lower end of oil filled chamber 24.

A bypass valve is provided in metering piston 40 to bypass the metering device 44 and includes a V-groove 58 having an O-ring 59 therein. A bypass flow port 60 is provided through metering piston 40 from the bottom of V-groove 58 to the fluid passageway provided by grooves 51. It can thus be seen that fluid flow from the upper end of metering piston 40 will flow through metering device 44, flow ports 54 and 55, the lower end of grooves 51 through flow port 56 to the lower end of chamber 24. With metering piston 40 moving in the upward direction with relationship to the outer housing, the higher pressure in the upper portion of oil filled chamber 24 will cause O-ring 59 to be moved into sealing engagement with the bottom portion of V-groove 58 such that flow through flow ports 60 is prevented. When the metering piston 40 is moving downwardly with respect to the outer housing assembly 10, higher pressure in the lower portion of the oil filled chamber 24 will be established and flow through flow port 60 will push the O-ring outwardly and allow flow around the O-ring 59 to bypass the metering means 44 in the metering piston 40.

A mechanical type check valve having a spring and a ball such as those available from the Lee Company of Westbrook, Conn. may be used in place of the bypass valve shown in FIG. 1*b*.

Turning now to the dump valve 45 of the apparatus, dump ports 62 are provided through dump valve sleeve 46 to provide for fluid flow between the upper portion of chamber 24 into the fluid passageway provided by grooves 52.

A dump valve covering collar 63 is provided with a capped end 61 and is slidable between an upper position which covers flow port 62 to a lower position which opens port 62 through slots 70 of the upper slotted extension of collar 63. Seals 64 and 65 are provided on either end of dump valve port 62 to furnish a seal when the dump valve covering collar 63 is in its upper position. A dump valve spring 67 is provided in the space between the metering piston 40 and the capped end 61 of the dump valve covering collar 63 to hold the dump valve closed in its normal position.

A tripping mechanism to open the dump valve 45 is shown at 72. This tripping mechanism 72 includes a ring 73 which is designed to engage with the slotted extension 70 to push collar 63 to the open position when the inner sliding mandrel assembly 11 moves sufficiently upwardly with relationship to outer housing assembly 10. The tripping mechanism 72 is held in position by spring fingers 74 which are attached to ring 73. On the unattached ends of spring fingers 74 are heads 75 which engage in a groove 77 in the housing section 13.

The upper end of groove 77 is provided with a beveled end 78 which coengage with the head 75 for camming the heads inwardly after the dump valve 45 has been opened.

The back side 80 of the hammer 30 is provided with a flat surface to pick up the upward facing ends of head 75 to move the tripping mechanism 72 back to the groove 77 during the recocking operation of the jar. Optional grooves 82 are provided in the hammer 30 to ensure unrestricted flow of oil past the hammer 30 during the power stroke of the jar.

In operation, the jar mechanism is connected into a drill string or other string in an oil well and lowered into the well bore during an operation such as drill stem testing or drilling of an oil well. When it is desired to remove the string, the string is lifted from the surface. When some component, such as a packer at the lower end of the string being removed from the oil well, sticks at a point below the jar, the jar mechanism is placed in tension such that the inner sliding mandrel moves upwardly with respect to the outer housing assembly. This relative movement of the two assemblies causes the metering piston 40 to move upwardly in oil filled chamber 24. The rate at which the housing assembly 10 and the inner mandrel 11 extend is controlled by the fluid metering device 44 in the metering piston 40. Fluid flow from the upper portion of the chamber 24 through the metering piston 40 is through the metering device 44, through the interconnecting ports 54 and 55 into the fluid passageway provided by grooves 52, through the grooves 52, then through the ports 56 in the end of seal retainer 42, and into the lower portion of chamber 24. During this upward motion of the inner mandrel assembly 11, the covering collar 63 of the dump valve 45 is maintained in the closed position by spring 67. When the slotted end 70 of the covering collar 63 has moved sufficiently upwardly in relation to the housing assembly 10, the slotted extension 70 engages with the ring 73 of the tripping mechanism 72. The outwardly directed bias of spring fingers 74 is sufficient to hold the tripping mechanism 72 in position while the spring 67 of the dump valve 45 is being compressed.

When the spring 67 has been compressed sufficiently by the continued upward movement of inner mandrel assembly 11, the slots 70 in the slotted extension of covering collar 63 uncover the dump valve ports 62 such that fluid flow is permitted from the upper portion of chamber 24 through the now uncovered port 62 and into the fluid passageway provided by grooves 52 to the lower portion of chamber 24. With the dump valve mechanism 45 now in the open position, fluid may freely move from the upper portion of chamber 24 to the lower portion of chamber 24 bypassing the metering device 44. Inner mandrel assembly 11 may now freely move in the upward direction. As the inner mandrel assembly 11 moves upwardly, the spring 67 is fully compressed and the additional force is sufficient to cam head 75 inwardly by the action of beveled edge 78 such that the tripping mechanism 72 now moves upwardly with the inner sliding mandrel assembly 11.

The energy stored in the testing string by the stretch of the string being pulled from the surface now causes inner mandrel assembly 11 to move rapidly upwardly until the hammer 30 strikes the anvil 31 imparting a blow to the stuck lower portion of the string.

To recock the device, the string is lowered from the surface thus causing inner mandrel assembly 11 to move downwardly in relation to the outer housing assembly 10. This downward movement of assembly 11 causes the slotted extension 70 to become disengaged from ring 73 of the tripping mechanism 72. Compressed spring 67 may now expand to move the covering collar 63 to its upward position thus sealing ports 62 and closing dump valve mechanism 45.

The downward movement of mandrel assembly 11 also moves metering piston 40 downwardly. Fluid moving from the lower portion of chamber 24 through grooves 52 and into port 60 push O-ring 59 outwardly such that the bypass mechanism provided by V-groove 58 and O-ring 59 is open to allow fluid to bypass the metering means 44. The assemblies 10 and 11 of the jar may then be moved back to the initial position shown in FIGS. 1*a* and 1*b* of the drawings. When the inner mandrel assembly 11 moves sufficiently downwardly, the head 75 of the tripping mechanism 72 is engaged with the lower end 80 of hammer 30 and the tripping mechanism 72 is moved downwardly to its initial position. Spring fingers 74 are then urged outwardly into groove 77 in the housing section 13.

The illustrated jar is then in the recocked position and is ready to be activated again to impart another blow to the stuck string.

Those familiar with the oil well apparatus will recognize that the metering means and tripping mechanism may be used in other devices wherein a time delay followed by a sudden release in resistance to provide a surface indication of telescopic movement is needed. For instance, such an arrangement may be used in U.S. Pat. No. 3,814,182 issued to Richard Giroux June 4, 1974, and reissued Nov. 15, 1977, as U.S. Pat. No. Re. 29,471, and assigned to the assignee of the present invention. The time delay and release mechanism of the present invention may be used in place of the hydraulic impedance valving system 122 shown in FIGS. 1*d* and 10 of the mentioned reissue patent.

The foregoing embodiments have been disclosed as illustrative embodiments of the invention. However, changes and modifications to these embodiments will be apparent to those skilled in the art. The appended claims are intended to cover such equivalent embodiments which may fall within the true spirit and scope of this invention.

What is claimed is:

1. In a jar apparatus for use in an oil well having:

a tubular outer housing;

an inner mandrel longitudinally slidable within said tubular outer housing and arranged to have an annular oil filled chamber between said outer housing and said inner mandrel;

an anvil means on the inner walls of said housing and projecting inwardly into said oil filled chamber;

a hammer means on the outer walls of said mandrel and projecting outwardly into said oil filled chamber and arranged for striking engagement with said anvil means after a predetermined sliding movement of said inner mandrel within said outer housing;

an annular metering piston on said inner mandrel in said oil filled chamber and having sealing means around its outer periphery in sealing engagement with the inner walls of said outer housing for controlling sliding movement of said inner mandrel within said outer housing;

oil metering means in said metering piston for controlling oil flow from one side of said metering piston to the other side of said metering piston for controlling the rate of movement of said inner mandrel within said outer housing in a first longitudinal direction;

dump valve means in said inner mandrel having an open position for allowing oil to flow around said metering piston and said oil metering means therein, and a normally closed position for closing oil flow around said metering piston such that the rate of movement of said inner mandrel when said dump valve is closed will be controlled by said oil metering means; and a dump valve operating mechanism in the oil filled chamber arranged for moving said dump valve means from its closed position to its open position after a predetermined amount of movement of said inner mandrel, the improvement comprising;

attachment means releasably attaching said dump valve operating mechanism to the inner wall of said outer housing for moving said dump valve means to said open position while said operating mechanism is attached to the inner housing wall, and subsequent to the opening of said dump valve, for releasing from the inner wall of said outer housing and sliding longitudinally with said inner mandrel during the unrestricted movement of said inner mandrel from the point where said dump valve is open to the point of striking engagement of said anvil means and said hammer means.

2. The apparatus of claim 1 wherein said outer housing has a groove in its inner walls;

said dump valve operating mechanism comprises a ring encircling said inner mandrel and extending longitudinally for operating said dump valve; and said attachment means comprises;

spring fingers attached to said ring, and heads terminating said spring fingers and urged outwardly into engagement with said inner walls of said outer housing by said spring fingers for fitting into said groove when said dump valve operating mechanism is positioned in said chamber at its normal position.

3. The apparatus of claim 2 wherein said inner mandrel has a longitudinal fluid passageway and an access port for allowing fluid flow from one side of said metering piston to the other side of said metering piston and arranged such that said fluid flow bypasses said oil metering means;

and the improvement further comprises:

a covering collar in said dump valve movable between a first position wherein said access port to said fluid passageway is blocked, and a second position wherein said access port to said fluid passageway is open for allowing oil to flow through said fluid passageway; and a spring means urging said covering collar to its first position and compressible by the operation of said dump valve operating mechanism for allowing said covering collar to move to its second position by a force less than the force required to cam said heads inwardly against said spring fingers by the action of the end of said groove on said spring finger heads for providing that said covering collar is moved to its second position before said dump valve operating mechanism attachment means is released from the groove in the wall of said outer housing.

4. The improvement of claim 2 comprising means on said inner mandrel for engaging and moving said dump valve operating mechanism toward its initial position wherein said spring finger heads fit into said groove; said dump valve operating mechanism movement responsive to movement of said inner mandrel in a second opposite longitudinal direction.

5. In an apparatus for use in an oil well having:

an outer tubular member;

an inner tubular member longitudinally slidable within said outer tubular member and arranged to have an oil filled chamber between said members;

a metering piston on one of said tubular member in said oil chamber and having a metering means therethrough for controlling longitudinal sliding movement between said tubular members;

dump valve means in one of said members having an open position for bypassing said metering means, and a closed position arranged such that when said dump valve means is in the closed position, slidable movement is controlled by oil flow through said metering means; and dump valve operating means arranged for moving said dump valve means from its closed position to its open position after a predetermined amount of movement between said members, the improvement comprising;

attachment means releasably attaching said dump valve operating means to the member other than the one having said dump valve means, and subsequent to the opening of said dump valve means, for releasing and sliding longitudinally with the movement of said tubular members while said dump valve means is in the open position.

* * * * *